United States Patent [19]

Bärnthaler et al.

[11] Patent Number: 4,664,449

[45] Date of Patent: May 12, 1987

[54] DRIFT ADVANCING OR MINING MACHINE

[75] Inventors: Franz Bärnthaler, Weisskirchen; Ferdinand Bedenk, Zeltweg; Otto Schetina, Zeltweg; Alfred Zitz, Zeltweg, all of Austria

[73] Assignee: Voest-Alpine Aktiengesellschaft, Linz, Austria

[21] Appl. No.: 770,785

[22] Filed: Aug. 29, 1985

[30] Foreign Application Priority Data

Aug. 31, 1984 [AT] Austria ..... 2802/84

[51] Int. Cl.[4] ..... E21C 27/20

[52] U.S. Cl. ..... 299/74; 299/75; 299/42

[58] Field of Search ..... 299/72–77, 299/42, 43, 31

[56] References Cited

U.S. PATENT DOCUMENTS

| | | | |
|---|---|---|---|
| 3,006,624 | 10/1961 | Duxey | 299/17 |
| 3,064,958 | 11/1962 | Osgood | 299/73 |
| 3,314,722 | 4/1967 | Webster | 299/31 |
| 3,418,023 | 12/1968 | Webster | 299/43 |
| 3,550,961 | 12/1970 | Hughes | 299/72 X |
| 3,929,378 | 12/1975 | Frenyo et al. | 299/76 X |
| 4,037,875 | 7/1977 | Justice | 299/12 X |
| 4,119,346 | 10/1978 | Amoroso | 299/31 X |
| 4,131,317 | 12/1978 | Jamison et al. | 299/75 X |

OTHER PUBLICATIONS

"Der Moderne Tunnel—Und Stollenvortrieb" of Berger, Verlag Wilhelm Ernst und Sohn, Berlin, pp. 114 to 122 and 128, 129, 1970.

*Primary Examiner*—Stephen J. Novosad
*Assistant Examiner*—Michael A. Goodwin
*Attorney, Agent, or Firm*—Cushman, Darby & Cushman

[57] ABSTRACT

A drift advancing or a partial-cut mining machine (1) comprises a cutting arm (11) being swivellable in a height direction around an axis (10). The front end of the cutting arm (11) is equipped with guides (26) transversely extending relative to the longitudinal axis (38) of the cutting arm (11) and having shiftably supported thereon a carrier (27) for the cutting heads (28, 29). The cutting heads (28, 29) are rotatably supported on the carrier (27) for rotation around vertical axes (46). The distance (a) between the axes of rotation (46) is, as measured in a transverse direction relative to the longitudinal axis (38) of the cutting arm, at most equal to half the width (b) of the drift face.

11 Claims, 3 Drawing Figures

DRIFT ADVANCING OR MINING MACHINE

BACKGROUND OF THE INVENTION

1. Field of the Invention

The invention refers to a drift advancing or mining machine, in particular equipped with a caterpillar chassis, comprising a cutting arm on which are arranged cutting heads and/or cutting rolls being rotatably supported for rotation around an axis transversely extending to the drift advancing direction.

2. Description of the Related Art

In usual cutting machines of the initially mentioned type, there is supported on a caterpillar chassis a cantilever arm or cutting arm, respectively, for being swivellable around an essentially vertical axis and around a substantially horizontal axis. For effecting excavations of greater cross-sectional area, the cantilever arm must be given a corresponding length, noting that when swivelling the cantilever arm in a lateral direction or in a height direction there results an essentially curved mining face. In the case of fragile drift roofs, it is necessary to effect the provisional consolidation of the drift near the mine face for preventing a collapse of the drift roof. Such a provisional consolidation is relatively expensive and time-consuming and can—in consideration of the also laterally swivellable cutting arm or, respectively, cantilever arm—not be moved arbitrarily close to the drift face. Furthermore, such a provisional consolidation requires correspondingly more expensive appliances for transporting the consolidating frames and auxiliary means for effecting the consolidation above the cutting machine located in front of the drift face, but the space at disposal near the drift face is correspondingly restricted. Additionally, with known devices it is only possible to erect the consolidation in proximity of the drift when stopping the cutting work, because a reliable protecting means can not be arranged between the cutting tools and locations located in proximity of the drift face, because such protecting means would collide with the cutting arm.

From DE-PS No. 29 30 136 there has become known a drift advancing machine for underground mining in which a track for a shiftably arranged support carrying cutting tools is provided on a stationary equipment being stabilized against the drift roof and the drift floor. Such a construction is relatively difficult to manuever and requires a relatively great space in the direction of the longitudinal drift axis. The cutting means are designed as augers and rotatable around axes substantially extending in the longitudinal direction of the drift. Together with the swivellable cantilever arms provided in this construction there results a relatively great total axial length.

SUMMARY OF THE INVENTION

The invention now aims at providing a device of the initially mentioned type which has—as seen in the drift advancing direction—a very short total length and which provides the possibility of establishing reliable shielding and thus of erecting the consolidation of the drift near the drift face without interrupting the cutting work. For solving this task, the device according to the invention essentially consists in that the cutting heads and/or cutting rolls are rotatable around axes located in a plane extending perpendicular to the drift floor and are arranged at the front end of the cutting arm for being shifted in a transverse direction relative to the axis of rotation. On account of the cutting heads and/or cutting rolls being rotatably supported for rotation around axes located in a plane perpendicularly extending relative to the drift floor, relatively great partial areas of the drift face can be worked, noting that the space requirement in the longitudinal direction of the drift is substantially reduced to the diameter of the cutting heads and/or cutting rolls. For working the total cross-sectional area it is, in this case, sufficient to shift these cutting heads and/or cutting rolls along the drift face and transversely relative to their axis of rotation, and it is only with drift sections of greater height that it can become necessary to additionally swivel the cutting arm in the height direction.

For supporting the cutting forces, the front end of the cutting arm preferably comprises guides transversely extending relative to the longitudinal axis of the arm and preferably extending at a right angle to this longitudinal axis, in which guides there or on which guides is guided a carrier for the cutting heads and/or cutting rolls in a shiftable manner and for being driven to effect shifting movement. Such a construction provides the possibility of using for the shifting drive simple appliances, for example a cylinder-piston-drive. Such guides are—as seen in the longitudinal direction of the drift—of shorter constructional length than swivellable arms, because the shifting drive for moving the cutting heads along the guides can be arranged in the same plane as the guides, whereas swivellable arms require an additional rotating drive.

In a constructively particularly simple manner, the guide is formed of two guiding profiles, such as grooves, tubes, claws or the like, being offset in the height direction and preferably being located one above the other in at least one operating position and being engaged by a corresponding counter-profile of the carrier in a form-locking manner and in a manner that the counter-profile is shiftable in the longitudinal direction of the guide. A construction reliable in operation can thus be achieved with relatively simple guiding profiles.

To be in the position to advance even drift sections of greater height, the cutting arm is preferably swivellable exclusively in the height direction and is pivotally linked to the movable advancing machine. Such restriction of the swivellability of the cutting arm to a swivelling movement in the height direction facilitates the lateral tight closing of the drift cross section immediately behind the guides, and such tight closing or, respectively, shielding provides the possibility of consolidation without any risk the drift immediately adjacent the shielding.

For further reducing the space requirement in the longitudinal direction, the arrangement is advantageously such that the cutting heads and/or cutting rolls are of hollow design and contain within their interior a rotation drive, in particular an electric motor and a gearing.

It is a common rule that the distance between adjacent anchor bores is predetermined in the longitudinal direction of the drift on account of the geological conditions. With fragile drift roofs, this distance can, for example, be reduced down to about 40 cm whereas in the presence of stabile drift roofs one can easily do with distances of about 1 m. For making the progress of the drift advancing work independent from the speed of erecting the consolidation, the arrangement is advantageously such that the swivelling axis of the cutting arm on the machine is arranged for being shiftable in the longitudinal direction of the cutting arm and/or in the height direction. When shifting the swivelling axis in the longitudinal direction of the cutting arm, the drift can be advanced without shifting the cutting machine itself, noting that the appliances for drilling anchor bores and applying anchors may remain in an unchanged position relative to the cutting machine or, respectively, the base frame thereof. Lifting of the swivelling axis provided for vertical swivelling movement of the cutting arm may contribute for to improving the cutting geometry, and in this manner a plane or nearly plane drift face can be excavated. In connection with drifts of relatively low height, it is, in this case, sufficient if the guiding profiles of the cutting arm are—in a lowered position of the cutting arm—located in a plane extending perpendicularly relative to the drift floor and extending transversely relative to the longitudinal axis of the cutting arm, so that when upwardly swivelling the cutting arm, the drift face is rounded-off only within the area located at a higher level and adjacent the drift roof. Such rounding-off provides the advantage that the drift roof is less subject to the risk of collapsing than is the case with a sharp-edged transition to the drift face.

For providing an additional protection of the drift consolidation erected behind the drift face as near as possible to this drift face, the arrangement is preferably such that the cutting arm extends through a substantially vertically extending slot of a shielding being supported on the cutting machine and being shiftable relative to the cutting machine in the longitudinal direction of the cutting arm, and that the shielding is provided, at its side facing the cutting machine, with appliances for drilling anchor bores and applying anchors.

By designing the shielding as a shielding being shiftable relative to the machine frame and in the longitudinal direction of the cutting arm, it becomes possible to make the consolidating work still further independent from the cutting work and, for example, to drill two or more rows of anchor bores preferably located within one common transverse plane of the drift and to place anchors within these rows during the time interval in which the drift face is once completely worked by the cutting tools.

Practice has shown that an edge-shaped transition from the drift floor into the drift face is desireable, whereas the transition from the drift face into the drift roof is—for the above mentioned reasons—preferably rounded off. For this purpose the arrangement is preferably such that the lower cutting head or cutting roll of the both cutting heads or cutting rolls arranged one above the other is substantially cylindrical or frustoconical in shape and the upper cutting head or cutting roll has substantially the shape of a mushroom or of a spherical calotte.

For reliably removing the material near the drift face, there is preferably arranged below the lowermost operating position of the guide of the cutting arm a removal means, in particular a conveyor screw being rotatable around an axis transversely extending relative to the longitudinal axis of the cutting arm, and a loading ramp associated to this removal means, the loading ramp being preferably connected with the cutting machine for being shiftable in the longitudinal direction of the cutting arm. The shiftability of the loading ramp in the longitudinal direction of the cutting arm provides the possibility to move the removal means into closer proximity of the drift face when the cutting arm has been lifted. The construction of the lower cutting head or, respectively, the lower cutting roll as a substantial cylindrical or frustoconical roll allows an operator to produce—if the removal means is retracted and if the rotation axis of the roll extends perpendicularly to the drift floor—plane floor cuts with a relatively sharp-edged transition into the drift face.

For improving the cutting efficiency and for obtaining greater speed advancing velocities it is—on account of the carrier construction being shiftable in the transverse direction to the drift advancing direction—possible to simultaneously operate a plurality of cutting heads and/or cutting rolls. For this purpose the carrier for the cutting heads and/or cutting rolls comprises at least two axes of rotation being staggered in a shifting direction and around which at least four cutting heads and/or cutting rolls are rotatable.

For avoiding a residual rib in the central area of four cutting heads and/or rolls, the arrangement is advantageously such that the lateral distance of the axes of rotation of the cutting heads and/or cutting rolls corresponds at most to half the width of the drift face. When there are arranged several adjacent cutting heads, said distance refers in principle always to the distance of the outermost cutting heads or, respectively, their axes. The provision of more than four cutting heads results, however, in no substantial advantages.

For laterally providing a transition from the drift face into the side wall, with which the inner width of the drift is greater than the width of the guides at the front end of the cutting arm, the arrangement is such that the carrier has the axes of rotation near or at its lateral border and that the cutting heads and/or the cutting rolls are—as seen in a top plan view—shiftably guided for extending beyond the lateral contour of the guides.

BRIEF DESCRIPTION OF THE DRAWINGS

In the following disclosure, the invention is further explained with reference to an embodiment shown in the drawings in which.

DETAILED DESCRIPTION OF THE PREFERRED EMBODIMENT

Figure 1:
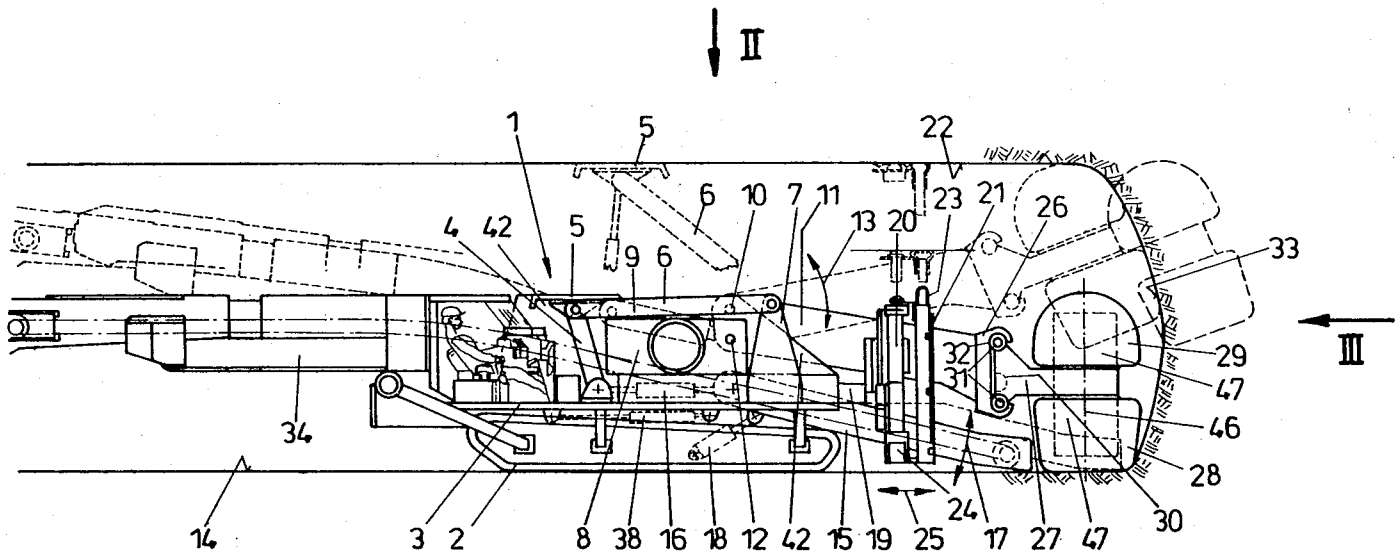
FIG. 1 shows a side elevation of the device according to the invention.

In FIG. 1, there is a movable drift advancing machine 1 having a caterpillar chassis 2. On the base frame 3 of the drift advancing machine 1, there is arranged a supporting construction comprising an extendable prop 4, a cap 5 to be pressed against the drift roof and a guide rod 6. The extended position of this cap 5 is indicated by dashed lines. The guide rod 6 is pivotally linked to a jack 7. There is further provided a machine distributer 8 which carries hydraulic and electric appliances of the machine.

On the base frame 3, there is further supported a swivelling cylinder 9 which acts on a cutting arm 11 via a pivot point 12 essentrically arranged relative to the pivot axis 10 of this cutting arm 11. By means of this swivelling cylinder 9 it is possible to swivel the cutting arm 11 in the sense of the twin arrow 13. Swivelling movement is, in this case, restricted to a swivelling movement in a plane vertically extending relative to the floor 14. On the frame 3 of the cutting machine there is further swivellably linked a removal means 15 being shiftable in the longitudinal direction of the drift advancing machine 1 by a hydraulic cylinder-piston-arrangement 16, noting that swivellability is made possible in the sense of the twin arrow 17. As a swivel drive means for this swivelling movement in the height direction, there is provided a hydraulic cylinder-piston-arrangement 18. The frame 3 of the cutting machine 1 further includes a carrier construction 19 being supported for shifting in the longitudinal direction of the cutting machine 1 and carrying at its free end an appliance 20 for drilling anchor bores and applying anchors as well as a shielding 21. The shielding 21 can be extended up to the drift roof 22, thereby elastically deforming the sealing elements 23. Likewise, a plurality of appliances 20 for drilling anchor bores and applying anchors can be supported on the drift floor 14 by means of a prop 24 and can be extended up to the drift roof 22. The carrier construction 19 is shiftable relative to the frame 3 of the machine in the longitudinal direction of the machine 1, which is indicated by the twin arrow 25. The free end of the cutting arm 11 carries a guide 26, in which a carrier 27 for cutting heads 28 and 29 is arranged for being shifted in a transverse direction relative to the longitudinal axis of the drift. The shifting drive means is formed of a hydraulic cylinder-piston-arrangement 30, and in the illustrated lowered position of the cutting arm 11, there are located two guide tubes 31 of the guide 26 one above the other within a plane substantially extending perpendicular to the drift floor. These guide tubes 31 are embraced by corresponding tubular counter-profiles 32 of the carrier 27. The mining face is designated by 33.

Figure 2:
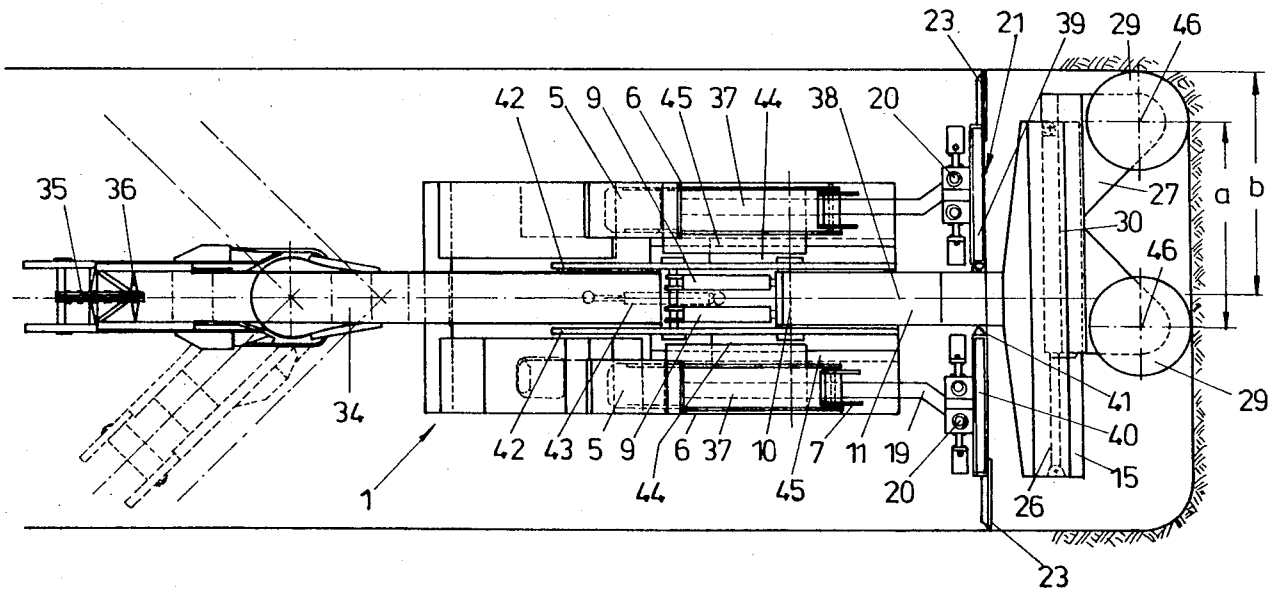
FIG. 2 shows a top plan view in the sense of the arrow II of FIG. 1

A swivellable conveyor 34 is connected to the rear end of the machine, the conveyor means being, as can be taken from FIG. 2, for example formed of scrapers 36 driven via a chain 35.

The representation according to FIG. 2 shows that the carrier construction 12 for the appliances 20 for drilling anchor bores and applying anchors and for the shielding 21 is shiftable in the longitudinal direction of the cutting machine, noting that two cylinder-piston-arrangements 37 are supported against the frame 3 of the cutting machine 1 for forming the shifting drive means. Both cylinder-piston-arrangements 37 are actuated such that the shielding 21 is advanced just in the normal direction relative to the longitudinal axis 38 of the machine. The shielding 21 is subdivided into at least two parts 39 and 40 located at both sides of the cutting arm 11, and a slot 41 extending in the height direction is provided between these both halves, said slot allowing movement of the cutting arm in the height direction by actuating the swivelling cylinders 9.

Figure 3:
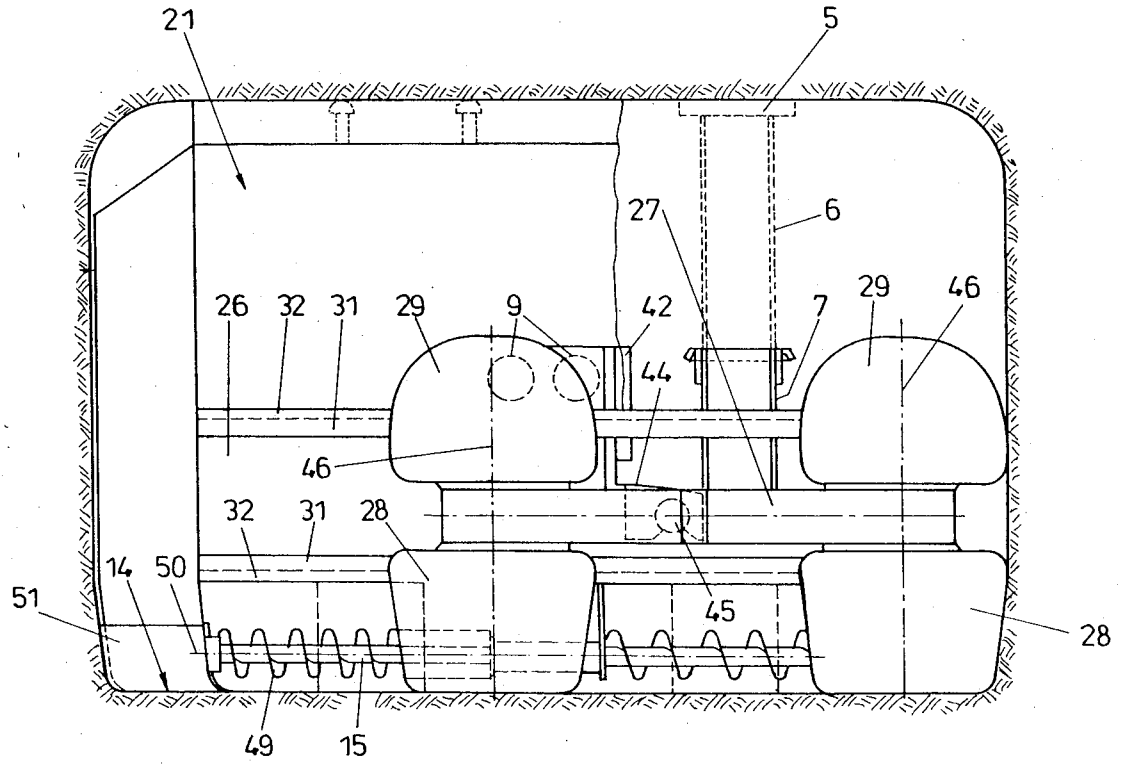
FIG. 3 shows a front view in the direction of the arrow III of FIG. 1.

The swivelling axis 10 of the cutting arm 11 is, like the swivelling axis of the removal means 15, supported in a shiftable frame 42, noting that this frame 42 can be shifted in the longitudinal axis 38 of the cutting machine 1 via a hydraulic cylinder-piston-arrangement 43. As shown in FIG. 3, the frame 42 has lateral claws 44 which embrace guide rods 45 extending in the longitudinal direction of the cutting machine.

A carrier 27 designed as a slide carriage is guided within the guide 26 at the free end of the cutting arm 11 and has rotatably supported thereon cutting heads or cutting rolls 28 and 29, respectively, which are rotatable around axes 46 substantially extending perpendicular to the drift floor. As can be seen from FIG. 1, these cutting heads or cutting rolls 28 and 29, respectively, are hollow within their interior and house within their cavities drive means 47 formed of electric motors and gearings. The distance a of both adjacent axes 46 corresponds to half of the width b of the drift to be advanced. The cutting heads or cutting rolls, respectively, which are located side by side when seen in a top plan view, are advantageously driven in an opposite sense for warranting a better stabilization and force transmission into the cutting arm 11.

The lateral margin of the shielding 21 is again reliably provided by sealings 23 being elastically deformable or being extendable and elastic. In an analogous manner, the slot 41, extending in the height direction, of the shielding 21 is sealingly annexed to the cutting arm. In the construction shown, swivellability of the cutting arm is restricted to a substantially vertical swivellability. If horizontal swivellability shall be admitted, the slot 41 must be given a corresponding width and be lined with sealings being shiftable in the horizontal direction or being elastically deformable. These sealings are schematically indicated by 48.

In the representation according to FIG. 3, there is additionally visible the removal means 15, formed of a conveyor screw 49. The conveyor screw 49 is rotatably supported for rotation around an axis 50 extending substantially transversely to the advance direction. For improving uptake of material laterally accumulating over the width of the screw conveyor 49, there are provided outwardly swivellable shovels 51 which in their outwardly swivelled position extend up to the side wall of the drift.

What is claimed is:

1. Drift advancing or partial-cut mining machine (1), in particular equipped with a caterpillar chassis (2), comprising:

a cutting arm (11) on which there is arranged one of cutting heads (28, 29) and cutting rolls rotatably supported for rotation around an axis transversely extending to the drift advancing direction, said cutting arm having a swivelling axis, characterized in that one of the cutting heads (28, 29) and cutting rolls is rotatable around an axis of rotation (46) located in a plane extending perpendicular to the drift floor and is arranged on the front end of the cutting arm (11) for being shifted in a transverse direction relative to the axis of rotation (46), further characterized in that the cutting heads (28, 29) and cutting rolls are of hollow design and contain within their interiors a rotation drive (47), and further characterized in that the swivelling axis (10) of the cutting arm (11) is shiftably arranged, relative to the mining machine, in the drift advancing direction.

2. Drift advancing or mining machine as claimed in claim 1, characterized in that the front end of the cutting arm (11) comprises guides (26) transversely extending relative to a longitudinal axis of the cutting arm (11) on which guides (26) there is guided a carrier (27) for the cutting needs (28, 29) and cutting tools in a shiftable manner and for being driven to effect shifting movement.

3. Drift advancing or mining machine as claimed in claim 2, characterized in that each of the guides (26) is formed of two guiding profiles (32) spaced and located one above the other in at least one operating position and being engaged by a corresponding counter-profile (32) of the carrier (27) in a form-locking manner and in a manner that the counter-profile is shiftable in a longitudinal direction of the guide.

4. Drift advancing or mining machine as claimed in claim 3, characterized in that the guiding profiles (31) are—in a lowered position of the cutting arm (11)—located in a plane extending perpendicularly relative to the drift floor and extending transversely relative to the longitudinal axis (38) of the cutting arm (11).

5. Drift advancing or mining machine as claimed in claim 4, characterized in that the cutting arm (11) extends through a substantially vertically extending slot (41) of a shielding (21) being supported on the cutting machine (1), said shielding (21) also being shiftable relative to the cutting machine in the drift advancing direction, and said shielding (21) being connected at its side facing the cutting machine (1) with appliances (20) for drilling anchor bores and applying anchors.

6. Drift advancing or mining machine as claimed in claim 5, characterized in that one of a lower cutting head (28) and a cutting roll of the cutting heads and cutting rolls is substantially cylindrical or frustoconical in shape and an upper cutting head (29) has substantially the shape of a mushroom or a spherical calotte.

7. Drift advancing or mining machine as claimed in claim 6, characterized in that, below a lowermost operating position of the guiding profiles (31) of the cutting arm (11), there is arranged a screw conveyor (49) being rotatable around an axis transversely extending relative to the longitudinal axis (38) of the cutting arm (11).

8. Drift advancing or mining machine as claimed in claim 7, further comprising:

a carrier (32) for one of the cutting heads (28, 29) and cutting rolls, said carrier having at least two axes of rotation (46) around which at least four cutting heads (28, 29) and cutting rolls are rotatable.

9. Drift advancing or mining machine as claimed in claim 8, characterized in that a lateral distance (a) between the axes of rotation (46) of the cutting heads (28, 29) and/or cutting rolls is equal at most to half a width (b) of the drift face (33).

10. Drift advancing or mining machine as claimed in claim 9, characterized in that the carrier (32) has the axes of rotation (46) near or at its lateral border and in that the cutting heads (28, 29) and/or the cutting rolls are—as seen in a top plan view—shiftably guided for extending beyond a lateral contour of the guiding profiles (31).

11. Drift advancing or mining machine as claimed in claim 1, characterized in that the cutting arm (11) is swivellable and pivotally linked to the movable advancing machine (1).

* * * * *